US011236649B2

(12) United States Patent
Harada

(10) Patent No.: US 11,236,649 B2
(45) Date of Patent: Feb. 1, 2022

(54) INTERNAL COMBUSTION ENGINE UNIT

(71) Applicant: Honda Motor Co., Ltd., Tokyo (JP)

(72) Inventor: Toru Harada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/847,936

(22) Filed: Apr. 14, 2020

(65) Prior Publication Data

US 2020/0332684 A1 Oct. 22, 2020

(30) Foreign Application Priority Data

Apr. 18, 2019 (JP) ..... JP2019-079242

(51) Int. Cl.
*F01M 11/00* (2006.01)
*F01M 11/06* (2006.01)

(52) U.S. Cl.
CPC ..... *F01M 11/0004* (2013.01); *F01M 11/065* (2013.01); *F01M 2011/007* (2013.01); *F01M 2011/0033* (2013.01); *F01M 2011/0041* (2013.01); *F01M 2011/0066* (2013.01); *F01M 2011/0079* (2013.01)

(58) Field of Classification Search
CPC ..... F01M 11/0004; F01M 11/065; F01M 2011/0066; F01M 2011/0041; F01M 2011/007; F01M 2011/0033; F01M 2011/0079; F01M 2011/028; F01M 1/06; F01M 2001/068
See application file for complete search history.

(56) References Cited

U.S. PATENT DOCUMENTS

2013/0146015 A1* 6/2013 Akaishi ..... F16F 7/10 123/192.2

FOREIGN PATENT DOCUMENTS

JP 3730610 B2 1/2006
JP 2017082638 A 5/2017

* cited by examiner

*Primary Examiner* — Jacob M Amick
*Assistant Examiner* — Charles J Brauch
(74) *Attorney, Agent, or Firm* — Duft & Bornsen, PC

(57) ABSTRACT

An internal combustion engine unit including an internal combustion engine body, a balancer device attached to a lower portion of the internal combustion engine body, and an oil pan attached to the lower portion of the internal combustion engine body so as to surround the balancer device. The balancer device is disposed facing an outlet of an oil outflow hole, and the oil outflow hole is formed in the internal combustion engine body so as to return a lubricating oil in the internal combustion engine body to the oil pan.

8 Claims, 6 Drawing Sheets

INTERNAL COMBUSTION ENGINE UNIT

CROSS-REFERENCE TO RELATED APPLICATION

This application is based upon and claims the benefit of priority from Japanese Patent Application No. 2019-079242 filed on Apr. 18, 2019, the content of which is incorporated herein by reference.

BACKGROUND OF THE INVENTION

Field of the Invention

This invention relates to an internal combustion engine unit including an internal combustion engine into which lubricating oil is supplied.

Description of the Related Art

Conventionally, as this type of apparatus, there is a known apparatus, described in Japanese Examined Patent Publication No. 3730610 (JP3730610B2). The apparatus of JP3730610B2 is configured to return lubricating oil in an internal combustion engine to an oil pan through a through hole formed in a balancer device fastened to a lower portion of an engine body.

However, to return the lubricating oil to the oil pan at suppressed speed in the apparatus of JP3730610B2, it is necessary to form, in the balancer apparatus, a through hole that is a combination of a vertically extending longitudinal hole and a horizontally extending transverse hole, resulting in an increase in machining man-hours.

SUMMARY OF THE INVENTION

An aspect of the present invention is an internal combustion engine unit including: an internal combustion engine body; a balancer device attached to a lower portion of the internal combustion engine body; and an oil pan attached to the lower portion of the internal combustion engine body so as to surround the balancer device. The balancer device is disposed facing an outlet of an oil outflow hole, and the oil outflow hole is formed in the internal combustion engine body so as to return a lubricating oil in the internal combustion engine body to the oil pan.

BRIEF DESCRIPTION OF THE DRAWINGS

The objects, features, and advantages of the present invention will become clearer from the following description of embodiments in relation to the attached drawings, in which.

DETAILED DESCRIPTION OF THE INVENTION

Figure 1:
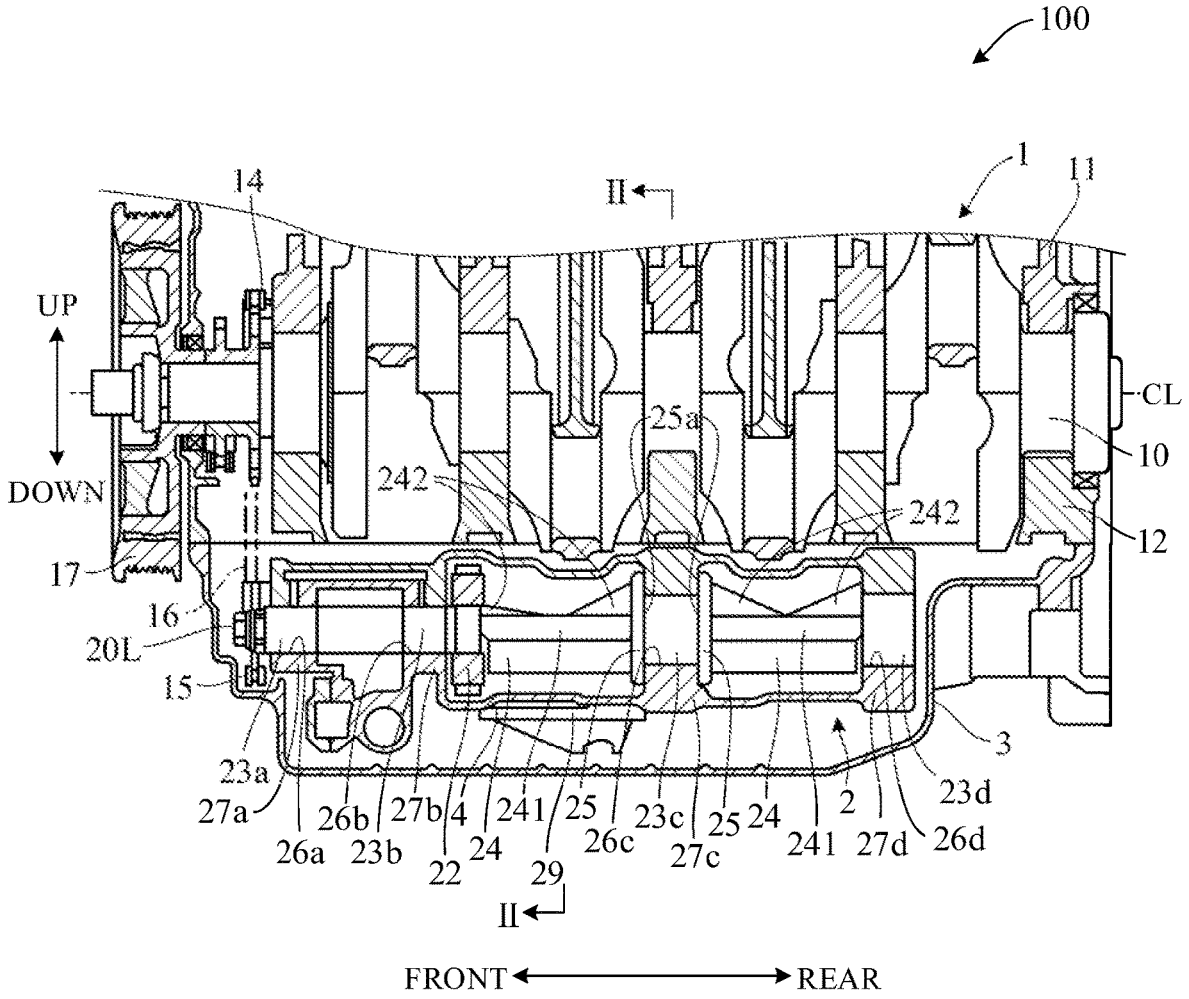
FIG. 1 is a sectional view schematically showing main components of an engine to which an internal combustion engine unit according to the embodiment of the present invention is applied.

Hereinafter, an embodiment of the present invention is explained with reference to FIGS. 1 to 6. The front-rear direction, the up-down direction, and the left-right direction perpendicular to each other are defined as shown in the drawings, and the configuration of the components will be described in accordance with this definition. The up-down direction is the gravity direction (the height direction of the vehicle), and the left-right direction is, for example, the length or width direction of the vehicle.

Figure 2:
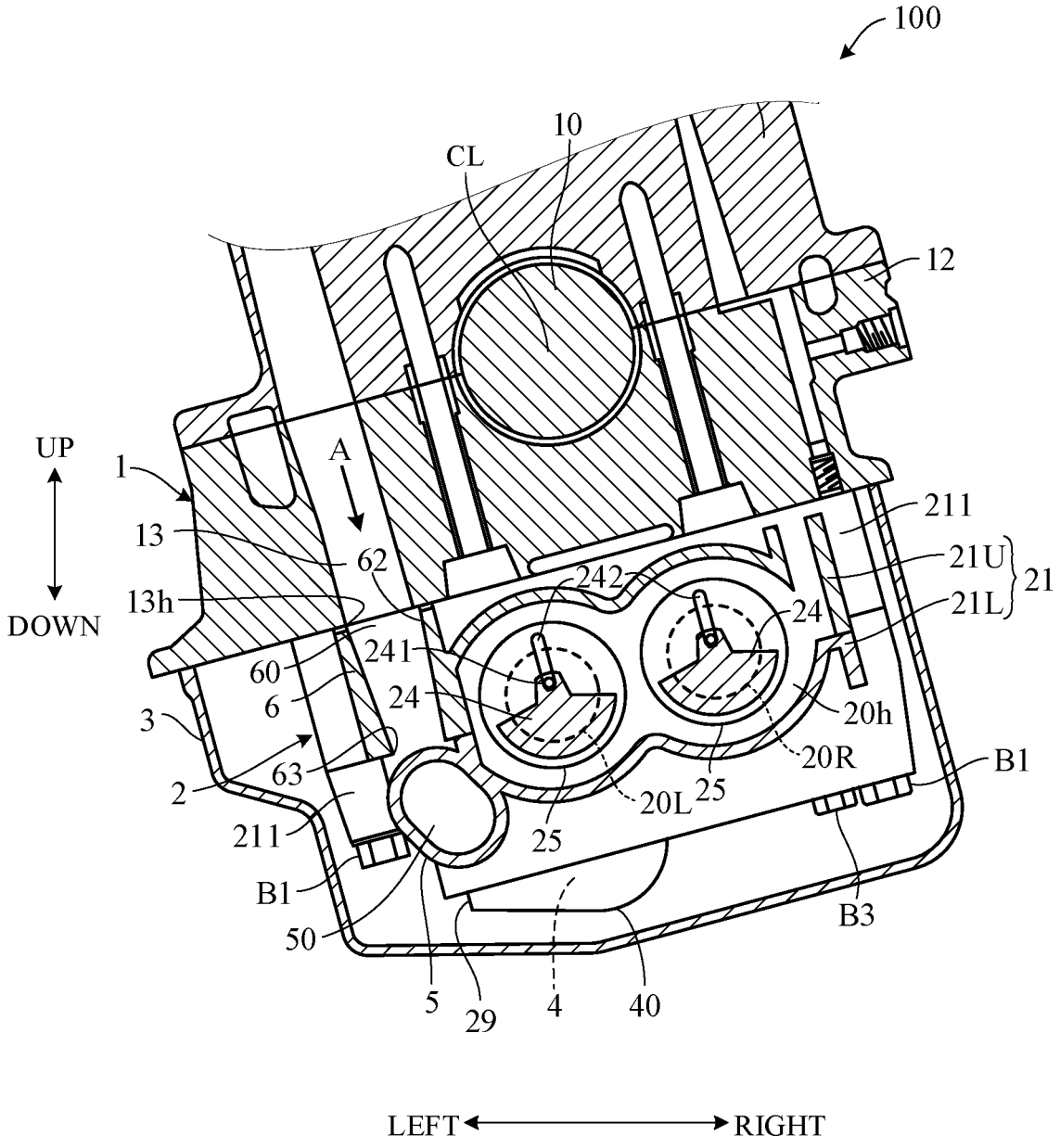
FIG. 2 is a sectional view taken along line II-II of the engine of FIG. 1.

FIG. 1 is a sectional view schematically showing main components of an engine 100 to which an internal combustion engine unit according to the embodiment of the present invention is applied. FIG. 2 is a sectional view taken along line II-II of FIG. 1.

As shown in FIG. 1, the engine 100 includes an engine body 1, a balancer device 2 attached to a lower portion of the engine body 1, and an oil pan 3 attached to the lower portion of the engine body 1 so as to surround the balancer device 2.

The engine body 1 includes a crankshaft 10 extending along an axis CL extending in the front-rear direction, a cylinder block 11, and a lower block 12 and is formed as, for example, an in-line four-cylinder engine. The crankshaft 10 is rotatably supported between the cylinder block 11 and lower block 12.

As shown in FIG. 2, the engine 100 is mounted on the vehicle body with a cylinder axis (not shown), which is the cylinder center line, inclined in the left-right direction. That is, the engine 100 is mounted on the vehicle body with the cylinder axis inclined leftward such that an upper portion thereof is located in a more left position than a lower portion thereof.

The engine body 1 is provided with a through hole (an oil outflow hole) 13 for returning, to the oil pan 3, oil that has lubricated the components in the engine body 1. The through hole 13 is formed so as to pass through the left ends in the left-right direction of approximately central portions in the front-rear direction of the cylinder block 11 and lower block 12.

That is, the through hole 13 passes through a lower-left portion of the engine body 1. An outlet **13*h* for discharging the oil to the oil pan 3 is formed in the lower surface of the lower block 12. Since the through hole 13 is formed in the lower-left position of the leftward-inclined engine body 1, the oil in the engine body 1 easily flows into the oil pan 3**.

The through hole 13 is approximately in the shape of a cylinder, and the outlet **13*h*** is approximately in the shape of a circle. The shapes of the through hole and outlet are not limited thereto. For example, the through hole may be in the shape of a circular truncated cone, and the outlet may be in the shape of an ellipse.

The balancer device 2 is configured to reduce secondary vibrations of the engine 100 caused by reciprocation of the piston of the engine body 1. The balancer device 2 is fastened to the lower surface of the lower block 12 of the engine body 1 using multiple bolts B1 inserted into the left and right ends of the balancer device 2 from below. The balancer device 2 is also disposed so as to face the outlet **13*h* of the through hole 13 and to be spaced from the outlet 13*h*** by a predetermined clearance.

The balancer device 2 includes a pair of left and right balancer shafts 20R and 20L having approximately the same shapes and a housing 21 that rotatably supports the two balancer shafts 20R and 20L such that the balancer shafts are parallel with each other.

The housing 21, which houses the two balancer shafts 20R and 20L, includes an upper housing 21U and a lower housing 21L that are formed by vertically dividing the housing 21 along a plane passing through the centers of the balancer shafts 20R and 20L and joined together. The balancer shafts 20R and 20L are located below the crankshaft 10, and the balancer shaft 20L is located adjacent to the outlet 13*h* of the through hole 13.

As shown in FIG. 1, a small sprocket 15 is fixed to the front end of the balancer shaft 20L. The front end of the crankshaft 10 is provided with a crank pulley 17, and a large sprocket 14 is fixed to the crank pulley 17. A link chain 16 is hung on the large sprocket 14 and small sprocket 15. The rotational force of the crankshaft 10 is transmitted to the balancer shaft 20L by the link chain 16, resulting in rotational drive of the balancer shaft 20L.

For example, the balancer shaft 20L is rotationally driven in the same direction as the direction of the crankshaft 10 at a rotation speed that is twice that of the crankshaft 10. The rotational speed ratio of the balancer shaft 20L can be changed as necessary by adjusting the sizes of the large sprocket 14 and small sprocket 15.

Helical gears 22 are integrally disposed on the balancer shafts 20R and 20L so that the balancer shafts can be interlocked with each other through the helical gears 22. Specifically, the balancer shaft 20R is rotationally driven in a direction opposite to that of the balancer shaft 20L due to engagement between the helical gears 22 integrally disposed on the balancer shafts 20R and 20L.

The balancer shafts 20R and 20L include small-diameter first and second journals 23*a* and 23*b* in front of the helical gears 22, and include large-diameter third and fourth journals 23*c* and 23*d* behind the helical gears 22.

Front and rear counter weights 24 that deflect the center of gravity radially outward from the rotation center are integrally disposed on a rear portion of each of the balancer shafts 20R and 20L so as to sandwich the third journal 23*c*.

Flanges 25 are formed on ends of the front and rear counter weights 24 so that the flanges 25 sandwich the third journal 23*c*. Diameters of the flanges 25 are greater than that of the third journal 23*c*. The mutually facing end surfaces of the flanges 25 (the end surf faces facing the third journal 23*c*) are provided with thrust receiving surfaces 25*a*.

To make the counter weights 24 as small as possible and then obtain the initial equivalent rotating mass, the diameters of shafts 241 of the counter weights 24 are made relatively small. To compensate for a reduction in the stiffness due the small diameter, ribs 242 are disposed over the entire lengths of the non-weight sides of both shafts 241 so as to axially connect the mounting portion of the helical gear 22 and the flange 25 disposed on the front side of the third journal 23*c* and axially connect the mounting portion of the helical gear 22 and the flange 25 disposed on the front side of the fourth journal 23*d*.

To minimize the increase in the weight due to the disposition of the ribs 242 and to optimize the stress distribution, the ribs 242 are in tapered shapes whose height sizes are smaller in positions closer to the axial center of each counter weight 24.

On the other hand, the first to fourth journals 23*a* to 23*d* of the balancer shafts 20R and 20L are supported by first to fourth bearing holes 26*a* to 26*d* that are formed by joining the upper housing 21U and lower housing 21L together and each consist of two halves.

To assemble the balancer device 2, first, the first to fourth journals 23*a* to 23*d* of the balancer shafts 20R and 20L are placed on the respective halves close to the lower housing 21L, of the first to fourth bearing holes 26*a* to 26*d*. Then, in this state, the respective halves close to the upper housing 21U, of the first to fourth bearing holes 26*a* to 26*d* are aligned with the first to fourth journals 23*a* to 23*d* of the balancer shafts 20R and 20L and then the upper housing 21U and lower housing 21L are joined together. Thus, the balancer shafts 20R and 20L are rotatably housed in the housing 21.

Figure 3:
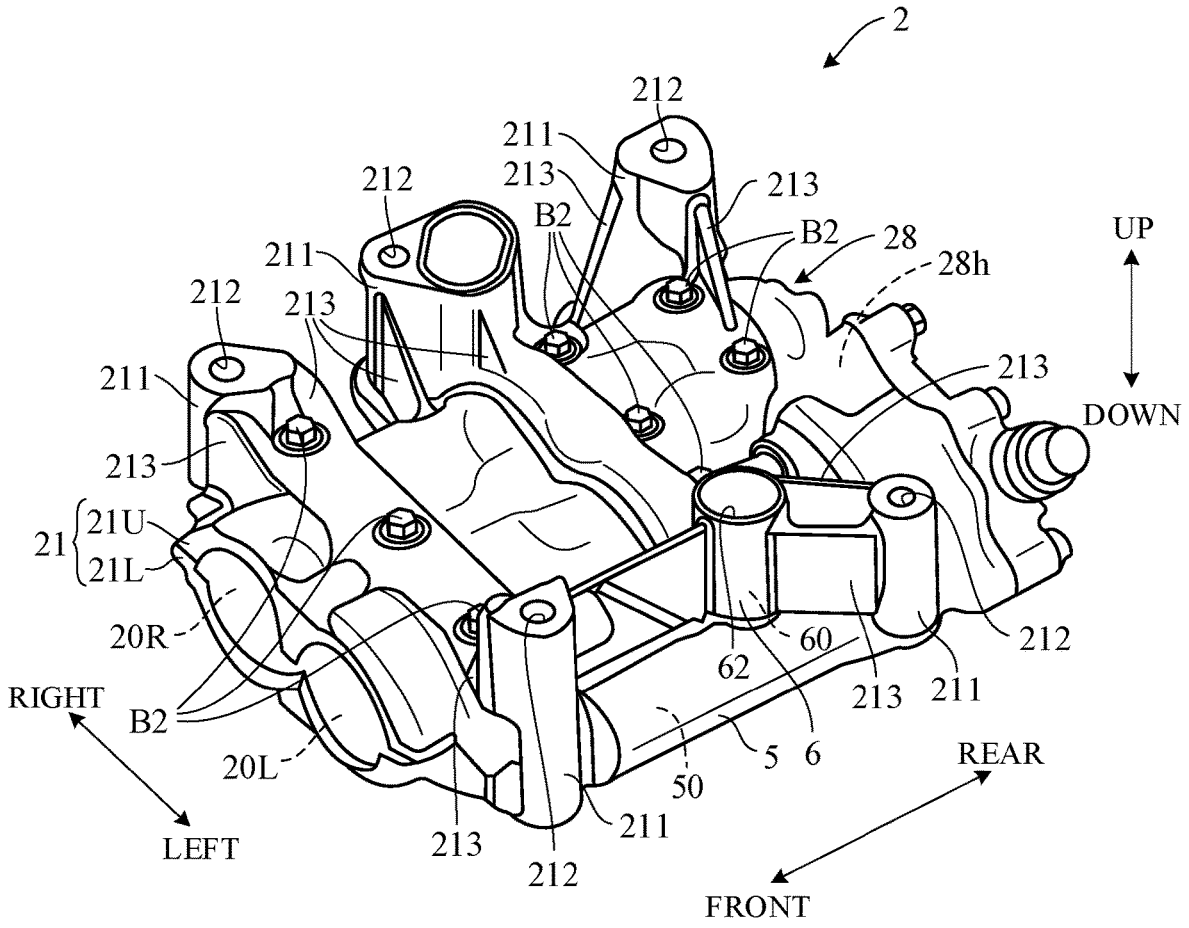
FIG. 3 is a perspective view of a balancer device of the engine of FIG. 1 seen obliquely from above.

The configuration of the housing 21 will be described. FIG. 3 is a perspective view of the balancer device 2 of the engine 100 seen obliquely from above.

As shown in FIG. 3, the housing 21 includes multiple fastening portions 211 that fasten the balancer device 2 to the engine body 1. The fastening portions 211 are disposed on the left and right ends of a front portion of the housing 21, the left and right ends of an approximately central portion in the front-rear direction thereof, and the right end of a rear portion thereof.

Bolt holes 212 into which bolts B1 can be inserted are formed in the fastening portions 211 so as to pass through the fastening portions in the up-down direction. The housing 21 is fastened to the lower surface of the lower block 12 by screwing the bolts B1 inserted into the bolt holes 212 of the fastening portions 211 from below, into fastening holes (not shown) formed in the lower surface of the lower block 12.

Each fastening portion 211 is approximately in the shape of a cylinder. Two ribs 213 is disposed on each fastening portion 211 in a standing manner so as to extend inwardly (inwardly in the left-right direction and inwardly in the front-rear direction) from the outer circumferential surface of the housing 21. Each rib 213 is in a tapered shape whose length in the up-down direction is shorter in positions closer to the inside of the housing 21. The two ribs 213 disposed on each fastening portion 211 allow for increasing the strength or stiffness of the fastening portions 211 while suppressing an increase in the weight of the housing 21. This allows for optimizing the distribution of stress acting on the fastening portions 211 while suppressing the weight.

Figure 4:
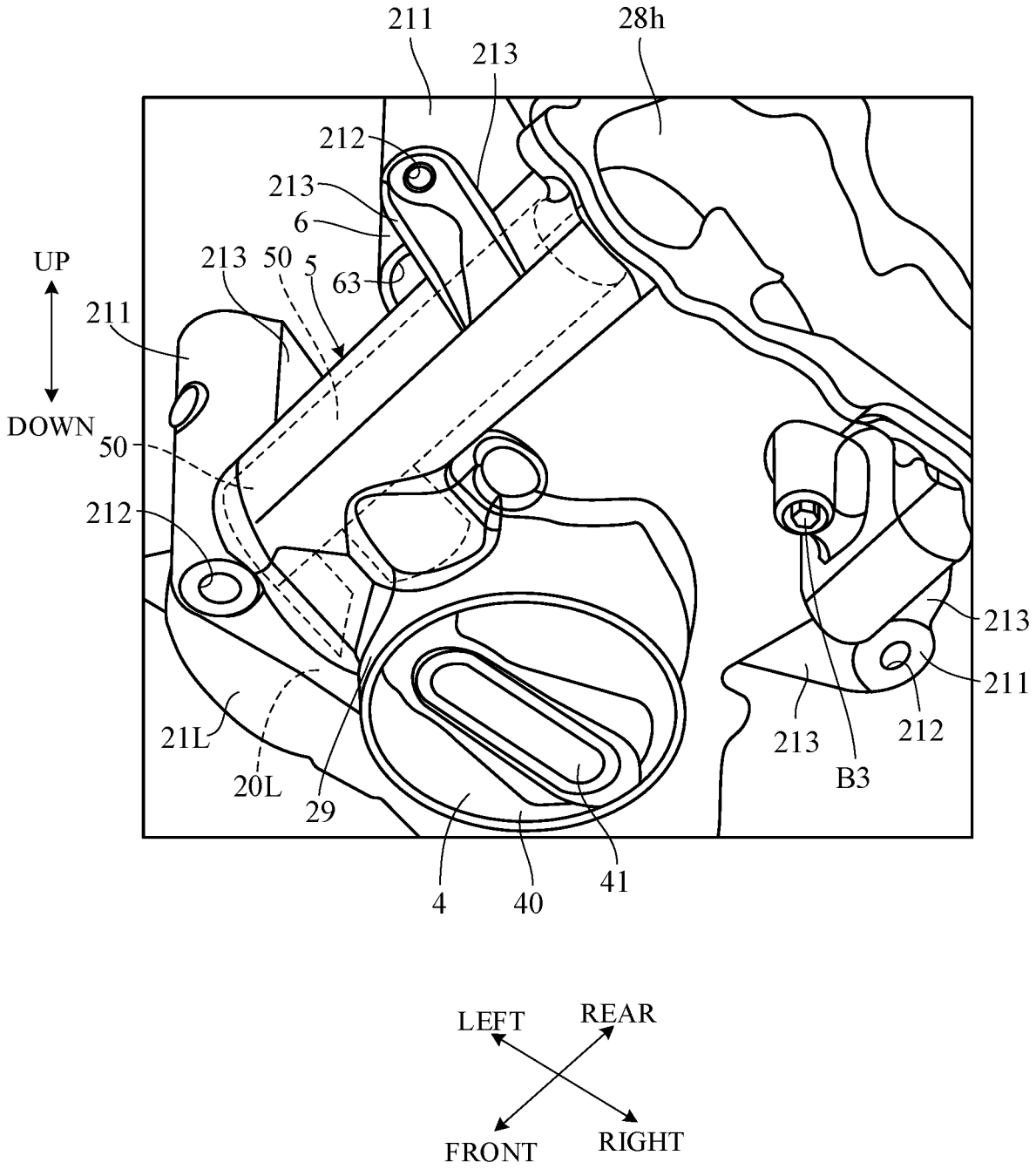
FIG. 4 is a perspective view of a main component of the balancer device of the engine of FIG. 1 seen obliquely from below.

FIG. 4 is a perspective view of a main component (the left end) of the balancer device 2 seen obliquely from below. As shown in FIGS. 3 and 4, the upper housing 21U and lower housing 21L are joined together by bolts B2 inserted from above in proper positions and bolts B3 inserted from below in proper positions.

Specifically, as shown in FIG. 3, the upper housing 21U and lower housing 21L are joined together by inserting and screwing, from above, the bolts B2 into multiple fastening portions (not shown) formed on right portions, approximately central portions, and left portions in the left-right direction of front portions, approximately central portions, and rear portions in the front-rear direction of the upper housing 21U and lower housing 21L.

Also, as shown in FIG. 4, the upper housing 21U and lower housing 21L are joined together by inserting and screwing, from below, the bolts B3 into fastening portions (not shown) formed so as to penetrate bearing walls 27*c* and 27*d* provided with the third and fourth bearing holes 26*c* and 26*d*. Since the upper housing 21U and lower housing 21L are joined together using the bolts B2 and B3 in these manners, portions of the bearing walls 27*c* and 27*d* acted upon by radial acceleration due to rotation of the counter weights 24 are less likely to be loosened.

Figure 5:
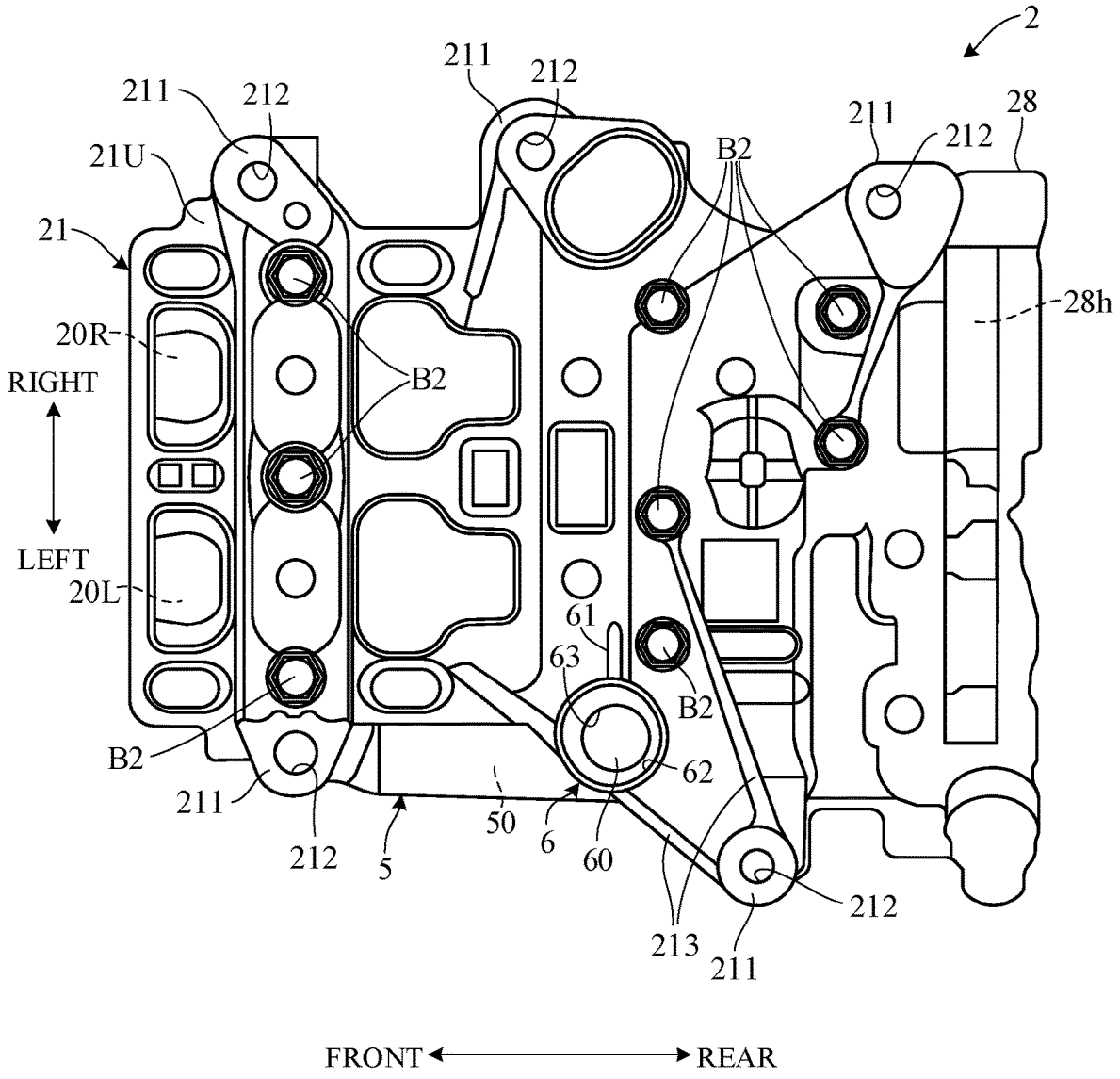
FIG. 5 is a plan view of the balancer device of the engine of FIG. 1.

FIG. 5 is a plan view (top view) of the balancer device 2. As shown in FIGS. 3 and 5, a pump housing 28 is mounted on the rear end of the housing 21. The pump housing 28 includes a pump container 28*h* for containing an oil pump (not shown). The oil pump is, for example, of trochoid type and is coupled to the rear end of the balancer shaft 20R. The pump container 28*h* and a shaft container 20*h* (see FIG. 2) containing the balancer shafts 20R and 20L communicate with each other.

As shown in FIG. 4, when the balancer shaft 20R is rotated, the oil pump sucks the oil stored in the oil pan 3 through an oil strainer 4 mounted on the bottom of the lower housing 21L so that the oil flows into the housing 21. The sucked oil is pressure-fed to the components of the engine body 1 through an oil circulation passage 50 formed in a swelling portion 5 (to be discussed later) of the housing 21. The oil that has lubricated the components in the engine body 1 is returned to the oil pan 3 through the through hole 13 (see FIG. 2) of the engine body 1 and along a guide 6 (to be discussed later) of the housing 21.

As shown in FIG. 2, the oil strainer 4 is disposed below the lower one of the two balancer shafts 20R and 20L in the lower housing 21L, that is, the balancer shaft 20L. Specifically, the oil strainer 4 is disposed such that the central portion thereof is located in a position adjacent to a vertical plane passing through the axis CL of the crankshaft 10, that is, in a position approximately directly below the center of gravity position of the engine body 1 mounted on the vehicle body.

Thus, the oil strainer 4 is disposed in a position in the oil pan 3 in which the oil level varies to a lesser extent. As a result, even if the level of the oil stored in the oil pan 3 varies due to front/rear acceleration, centrifugal force, or the like during travel, a reduction in the oil suction performance can be prevented.

As shown in FIG. 4, the oil strainer 4 is mounted to the bottom wall of the lower housing 21L through a strainer cover 40. The strainer cover 40 is formed so as to be able to hold the oil strainer 4 and mounted to the lower housing 21L through a mounting portion 29 integrally formed on the bottom wall of the lower housing 21L. The strainer cover 40 has an inlet 41 in a position in the oil pan 3 in which the oil level varies to the least extent.

The mounting portion 29 is approximately in the shape of a cylinder, and an outer circumferential portion thereof is coupled to the bearing wall 27*c* provided with a half of the third bearing hole 26*c* located in an approximately central portion in the front-rear direction of the lower housing 21L (see FIG. 1). This configuration allows for increasing the stiffness of the bearing wall 27*c* that joins the upper housing 21U and lower housing 21L together.

As shown in FIGS. 2 and 3, the swelling portion 5 is provided at the left end of the lower housing 21L included in the housing 21. This configuration allows for bringing the lower end of the swelling portion 5 close to the level of the oil stored in the oil pan 3.

In particular, the swelling portion 5 is provided at the left end of the lower housing 21L that is inclined leftward with the engine 100 mounted on the vehicle body. This configuration allows for bringing the lower end of the swelling portion 5 closer to the level of the oil stored in the oil pan 3.

As shown in FIG. 2, the outer surface of the swelling portion 5 swells leftward. More specifically, the swelling portion 5 swells to a more left position than the left end of the outlet 13*h* of the through hole 13 when seen along the through hole 13 with the balancer device 2 fastened to the engine body 1 (a view A). This configuration allows the oil discharged from the outlet 13*h* to drip or flow down onto the outer surface of the swelling portion 5.

The outer surface of the swelling portion 5 is in the shape of a protruding curved surface swelling leftward. In other words, it is formed in convex curved surface. This configuration allows the oil discharged from the outlet 13*h* of the engine body 1 to flow down to the lower end of the swelling portion 5 along the outer circumferential surface thereof, that is, allows for preventing the discharged oil from dripping or flowing down onto the oil pan 3 from some point of the swelling portion 5 before reaching the lower end of the swelling portion 5.

The swelling portion 5 also swells downward. This configuration allows for bringing the lower end of the swelling portion 5 closer to the level of the oil stored in the oil pan 3.

While, in FIG. 2, the cross-section of the swelling portion 5 is approximately in the shape of an ellipse, the cross-section of the swelling portion 5 may be in any shape. For example, the swelling portion 5 may be formed such that only a part of the outer surface is a curved surface.

As shown in FIGS. 3 to 5, the swelling portion 5 is formed on the left end of the lower housing 21L so as to extend in the front-rear direction. More specifically, the front end of the swelling portion 5 is located adjacent to the fastening portion 211 provided at a front-left portion of the housing 21, and the rear end of the swelling portion 5 is located on the joint surface of the pump housing 28. That is, the swelling portion 5 is approximately in the shape of a cylinder having a length from the fastening portion 211 provided at the front-left portion to the joint surface of the pump housing 28.

As shown in FIG. 4, the swelling portion 5 includes the oil circulation passage 50 that guides the oil stored in the oil pan 3 to the components in the engine body 1. In other words, the swelling portion 5 is configured by a member or portion forming the oil circulation passage that guides the oil stored in the oil pan 3 to the components in the engine body 1. This means that there is no need to provide a swelling portion separately from the swelling portion 5 forming the oil circulation passage 50, allowing for a reduction in the number of components or the number of process steps.

The front end of the oil circulation passage 50 communicates with the oil pan 3 through the oil strainer 4, and the rear end thereof communicates with the pump container 28*h* containing the oil pump.

Figure 6:
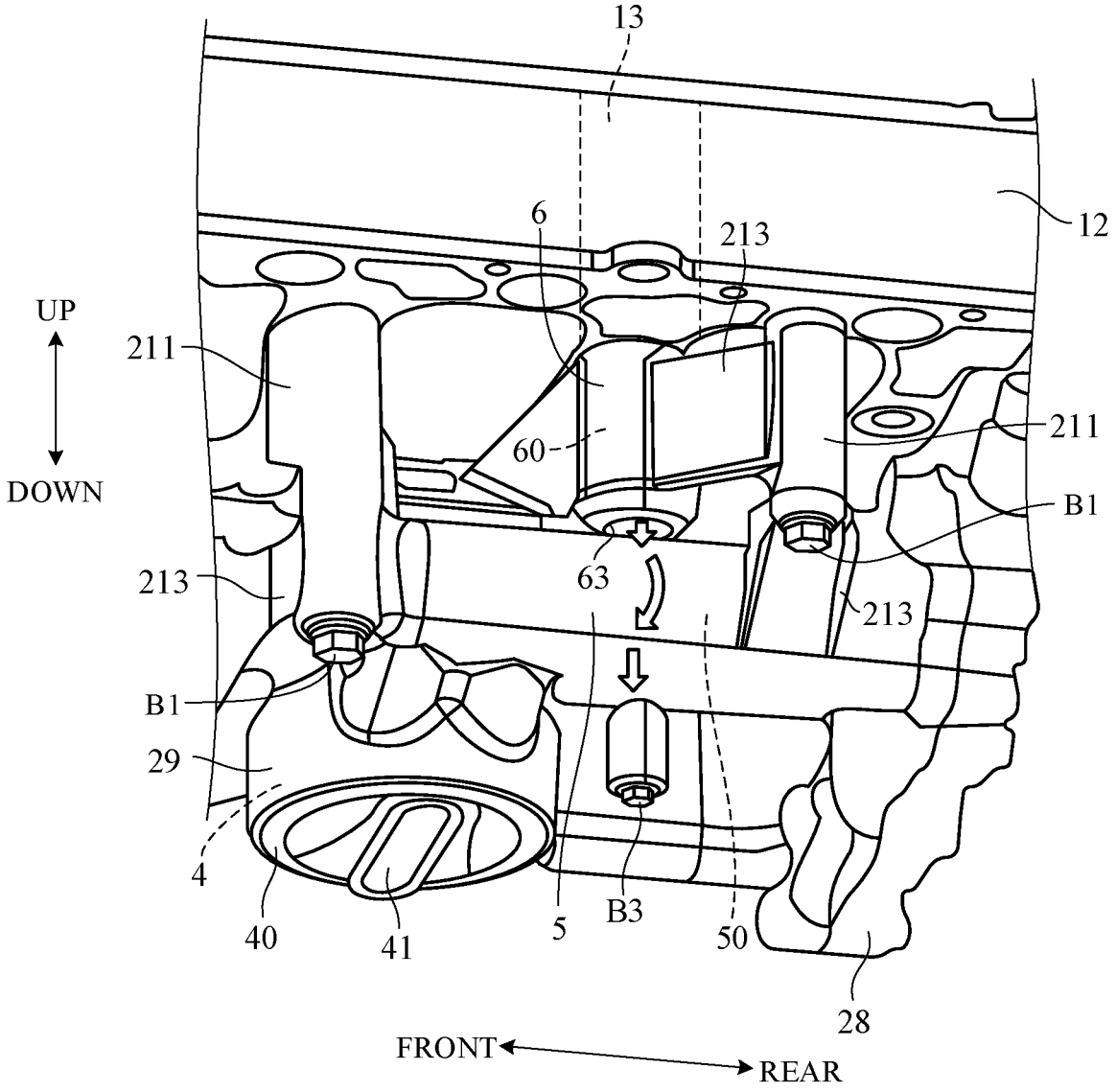
FIG. 6 is a perspective view showing a state where oil returns from the engine body of FIG. 1 through the balancer device to the oil pan.

FIG. 6 is a perspective view of the housing 21 seen from a lower-left position. As shown in FIGS. 4 and 6, the fastening portion 211 that fastens the balancer device 2 to the lower block 12 is disposed in a position adjacent to the rear end of the oil circulation passage 50. This configuration allows for fastening the balancer device 2 to the lower block 12 with higher stiffness.

The guide 6 shown in FIG. 6 is formed so as to be able to guide the oil discharged from the through hole 13 of the engine body 1 to the outer circumferential surface of the swelling portion 5 with the balancer device 2 fastened to the engine body 1. As shown in FIG. 2, the guide 6 includes a communication hole 60 that is able to communicate with the through hole 13 of the engine body 1 with the balancer device 2 fastened to the engine body 1, and the oil is guided to the outer circumferential surface of the swelling portion 5 through the communication hole 60.

The guide 6 is approximately in the shape of a cylinder and is provided at the left end in the left-right direction of an approximately central portion in the front-rear direction of the upper housing 21U included in the housing 21, as shown in FIG. 5. More specifically, the guide 6 is disposed between the two ribs 213 of the fastening portion 211 provided adjacent to the rear end of the oil circulation passage 50 and on the left side of the rear end, as well as is provided so as to be connected to one of the ribs 213.

A rib 61 is connected to the guide 6 so as to extend rightward from the outer circumferential surface of the guide 6. The rib 61 is in a tapered shape whose length in the up-down direction is shorter in positions closer to the right side of the housing 21. The ribs 61 and 213 provided at the guide 6 are able to increase the strength or stiffness of the guide 6 while suppressing an increase in the weight of the housing 21. That is, the distribution of stress acting on the guide 6 can be optimized while suppressing the weight.

As shown in FIG. 2, the guide 6 is disposed above the swelling portion 5 so as to face the swelling portion 5 through a predetermined clearance. The formation of the clearance between the guide 6 and swelling portion 5 allows the oil flowing along the guide 6 to flow out of the guide 6 through the clearance and then flow along the outer surface of the swelling portion 5.

An inlet 62 on the upper end of the communication hole 60 of the guide 6 is formed such that the cross-sectional area thereof is greater than the cross-sectional area of the outlet 13*h* of the through hole 13 formed in the engine body 1 (the lower block 12). Specifically, with the balancer device 2 fastened to the engine body 1, the inlet 62 of the communication hole 60 is formed so as to be larger than the outlet 13*h* of the through hole 13. In other words, with the balancer device 2 fastened to the engine body 1, the inlet 62 of the communication hole 60 is formed such that the outlet 13*h* of the through hole 13 is located inside the inlet 62 of the communication hole 60 in the view A in FIG. 2 along the through hole 13.

Since the inlet 62 of the communication hole 60 is larger than the outlet 13*h* of the through hole 13, the oil is able to reliably flow from the through hole 13 into the communication hole 60. Also, even if a clearance is formed between the lower block 12 and balancer device 2 with the balancer device 2 fastened to the engine body 1, the oil easily flows from the through hole 13 into the communication hole 60.

The communication hole 60 is in the shape of a circular truncated cone whose cross-sectional area is gradually reduced in the oil discharge direction (downward). That is, an outlet 63 of the communication hole 60 has a smaller cross-sectional area than the inlet 62. Thus, the oil is easily guided to the outer surface of the swelling portion 5.

As shown in FIG. 5, the inlet 62 of the communication hole 60 is approximately in the shape of an ellipse. Thus, even if the center position of the outlet 13*h* of the through hole 13 is displaced from the center position of the inlet 62, the oil is able to easily flow from the through hole 13 into the communication hole 60.

The outlet 63 of the communication hole 60 is approximately in the shape of a circle. In the view A in FIG. 2 along the through hole 13, the outlet 63 is located in a position that overlaps the outer surface of the swelling portion 5. Thus, the oil flowing through the communication hole 60 is able to reliably flow or drip down onto the outer surface of the swelling portion 5.

Next, the flow of the oil that lubricates the components in the engine 100 thus configured will be described. FIG. 6 is a perspective view schematically showing a state in which the oil returns from the engine body 1 in FIG. 1 to the oil pan 3 through the balancer device 2.

The oil flows so as to lubricate the components in the engine 100, and then is discharged from the outlet 13*h* formed in the lower surface of the lower block 12 of the engine body 1 through the through hole 13 formed in the engine body 1.

The oil discharged from the outlet 13*h* of the through hole 13 flows into the communication hole 60 of the guide 6 communicating with the through hole 13. Since the inlet 62 of the communication hole 60 has a larger cross-sectional area than the outlet 13*h* of the through hole 13, the oil reliably flows into the communication hole 60.

As shown in FIG. 6, the oil that has flown into the communication hole 60 is discharged from the outlet 63 of the communication hole 60. Since the outlet 63 is disposed in a position that overlaps the swelling portion 5 located below, the oil discharged from the outlet 63 drips or flows down onto the outer surface of the swelling portion 5.

The oil that has dripped or flowed down onto the outer surface of the swelling portion 5 flows downward along the outer surface of the swelling portion 5. Since the outer surface of the swelling portion 5 is in the shape of a curve, the oil easily flows downward along the outer surface of the swelling portion 5. The oil reaches a lower portion (e.g., the lower end) of the swelling portion 5 and then drips or flows down onto the oil pan 3 by gravity.

By driving the oil pump disposed in the pump housing 28, the oil stored in the oil pan 3 is sucked by the oil pump through the oil strainer 4 and the oil circulation passage 50 formed in the swelling portion 5 and then pressure-fed to the components in the engine body 1.

The present embodiment can achieve advantages and effects such as the following:

(1) The engine 100 serving as the internal combustion engine unit according to the present embodiment includes the engine body 1, the balancer device 2 attached to a lower portion of the engine body 1, and the oil pan 3 attached to the lower portion of the engine body 1 so as to surround the balancer device 2 (FIG. 1). The engine body 1 is provided with the through hole 13 (the oil outflow hole) for returning the oil that has lubricated the inside of the engine body 1, to the oil pan 3, and the balancer device 2 is disposed so as to face the outlet 13*h* of the through hole 13 (the outlet of the oil outflow hole) (FIG. 2).

This configuration eliminates the need to subject the balancer device 2 to perforation or the like and allows for suppressing the inflow speed at which the oil that has lubricated the engine body 1 is returned to the oil pan 3, that is, the speed at which the oil discharged from the through hole 13 drips or flows down onto the surface of the oil stored in the oil pan 3. Thus, when the discharged oil drips or flows down onto the oil pan 3, attraction of the air and thus bubbling of the stored oil can be prevented. Also, when the discharged oil drips or flows down onto the oil pan 3, generation of a sound can be suppressed.

(2) The balancer device 2 includes the swelling portion 5 that swells so as to cross the outflow direction (the arrow A in FIG. 2) of the oil flowing out of the through hole 13 (FIG. 2). The swelling portion 5 is disposed so as to face the outlet 13*h* of the through hole 13. This configuration allows for more effectively suppressing the inflow speed at which the oil that has lubricated the engine body 1 is returned to the oil pan 3, that is, the oil speed at which the oil discharged from the through hole 13 collides with the surface of the oil stored in the oil pan 3.

(3) The balancer device 2 includes the balancer shafts 20R and 20L and the housing 21 that rotatably supports the balancer shafts 20R and 20L (FIGS. 1 and 2). The housing 21 includes the upper housing 21U and lower housing 21L that are formed by vertically dividing the housing 21 and joined together, and the swelling portion 5 is provided at the lower housing 21L (FIGS. 2 and 4). This configuration allows for bringing the lower end of the swelling portion 5 closer to the surface of the oil stored in the oil pan 3, allowing for further suppressing bubbling of the stored oil and generation of a sound.

(4) The swelling portion 5 includes the oil passage that guides the oil stored in the oil pan 3 to the engine body 1, that is, the oil circulation passage 50 (FIG. 3). In other words, the swelling portion 5 is configured by an existing member or portion that forms the oil circulation passage 50 that returns the oil stored in the oil pan 3 to the engine body 1. For this reason, there is no need to separately dispose a swelling portion. Use of such a simple configuration allows for suppressing bubbling of the oil and generation of a sound when the oil returns to the oil pan 3.

(5) The swelling portion 5 is in the shape of a protruding curved surface so that the oil that has flown out from the through hole 13 flows along the outer circumferential surface of the swelling portion 5 (FIG. 2). Thus, the oil discharged from the through hole 13 smoothly flows downward along the outer surface of the swelling portion 5. That is, the discharged oil is prevented from dripping or flowing down onto the oil pan 3 from some point of the outer surface of the swelling portion 5 before reaching the lower end of the swelling portion 5.

(6) The swelling portion 5 is also provided so as to swell downward (FIG. 2). This configuration allows for bringing the swelling portion 5 closer to the oil surface in the oil pan 3, allowing for more effectively suppressing bubbling of the oil stored in the oil pan 3 and generation of a sound.

(7) The balancer device 2 includes the guide 6 that is disposed above the swelling portion 5 and guides the oil flowing out from the through hole 13 to the swelling portion 5 (FIG. 2). There is formed a clearance between the guide 6 and the swelling portion 5 (FIG. 2). This configuration allows for more reliably guiding the oil discharged from the through hole 13 to the outer surface of the swelling portion 5. Even if the outlet 13*h* of the through hole 13 and the swelling portion 5 are not located in positions that overlap each other in the view A in FIG. 2, the oil discharged from the through hole 13 can be guided to the outer surface of the swelling portion 5.

(8) The guide 6 includes the communication hole 60 (through hole) that communicates with the through hole 13 (FIG. 2). The outlet 63 of the communication hole 60 is disposed so as to face the swelling portion 5 (FIG. 2). This configuration allows for more reliably guiding the oil discharged from the through hole 13 to the outer surface of the swelling portion 5 through the communication hole 60.

In the above embodiment, the balancer device includes the housing 21 having the swelling portion 5 and the guide 6. However, a housing of a balancer device can be of any configuration insofar as adapted to include a swelling portion.

Although in the above embodiment, the swelling portion 5 is provided at the lower housing 21L, it can be provided at the upper housing 21U. In the above embodiment, the oil circulation passage 50 is formed in the swelling portion 5. However, an oil passage may be provided at a member other than the swelling portion 5.

In the above embodiment, the swelling portion 5 is swelled leftward and downward. However, a swelling portion can be of any configuration insofar as adapted to swell leftward, i.e., a direction orthogonal to an oil discharged direction.

The above embodiment can be combined as desired with one or more of the above modifications. The modifications can also be combined with one another.

According to the present invention, it is possible to effectively suppress an oil flow speed when returning lubricating oil in an internal combustion engine body to an oil pan while suppressing an increase in machining man-hours.

Above, while the present invention has been described with reference to the preferred embodiments thereof, it will be understood, by those skilled in the art, that various changes and modifications may be made thereto without departing from the scope of the appended claims.

What is claimed is:

1. An internal combustion engine unit, comprising:

an internal combustion engine body;

a balancer device attached to a lower portion of the internal combustion engine body; and an oil pan attached to the lower portion of the internal combustion engine body so as to surround the balancer device, wherein an oil outflow hole is formed in the internal combustion engine body so as to return a lubricating oil in the internal combustion engine body to the oil pan, wherein the balancer device includes a lower housing and an upper housing jointed with an upper side of the lower housing, the lower housing includes a swelling portion formed integrally with the lower housing and swelled so as to cross an outflow direction of the lubricating oil flowing out from an outlet of the oil outflow hole, the upper housing includes a guide formed integrally with the upper housing to guide the lubricating oil flowing out from the outlet of the oil outflow hole toward the swelling portion, the swelling portion is disposed facing the outlet of the oil outflow hole, is formed so as to swell outward at a side end portion of the lower housing, and includes an oil passage formed so as to supply the lubricating oil stored in the oil pan to the internal combustion engine body, the guide is formed at a side end portion of the upper housing so as to be disposed facing the outlet of the oil outflow hole, and includes a through hole configured to communicate with the oil outflow hole, and the through hole is disposed so that an entire area of an outlet of the through hole is covered with the swelling portion through a predetermined clearance.

2. The internal combustion engine unit according to claim 1, wherein the balancer device includes a balancer shaft and a housing configured to rotatably support the balancer shaft, and the housing includes the upper housing and the lower housing.

3. The internal combustion engine unit according to claim 1, further comprising an oil pump disposed at an end of the oil passage to supply the lubricating oil from the oil pan to the internal combustion engine body through the oil passage.

4. The internal combustion engine unit according to claim 3, wherein the swelling portion includes an oil inlet at a lower portion thereof to flow the lubricating oil from the oil pan into the oil passage.

5. The internal combustion engine unit according to claim 1, wherein the swelling portion includes an outer peripheral surface formed in a convex curved surface so that the lubricating oil flowing out from the outlet of the oil outflow hole flows down along the outer peripheral surface of the swelling portion.

6. The internal combustion engine unit according to claim 1, wherein the swelling portion is formed so as to further swell downward.

7. The internal combustion engine unit according to claim 1, wherein the through hole is in a shape of a circular truncated cone and a cross-sectional area thereof is gradually reduced in a downward direction.

8. The internal combustion engine unit according to claim 1, wherein an inlet of the through hole is formed so that a cross-sectional area thereof is greater than a cross-sectional area of the outlet of the oil outflow hole.

* * * * *